United States Patent [19]

Tremmel et al.

[11] Patent Number: 4,549,942

[45] **Date of Patent: * Oct. 29, 1985**

[54] PROCESS FOR ELECTRODEPOSITING COMPOSITE NICKEL LAYERS

[75] Inventors: Robert A. Tremmel, Woodhaven; Doina Magda, Grosse Pointe Park, both of Mich.

[73] Assignee: OMI International Corporation, Warren, Mich.

[ * ] Notice: The portion of the term of this patent subsequent to May 24, 2000 has been disclaimed.

[21] Appl. No.: 601,350

[22] Filed: Apr. 20, 1984

Related U.S. Application Data

[63] Continuation-in-part of Ser. No. 495,793, May 23, 1983, abandoned, which is a continuation-in-part of Ser. No. 280,643, Jul. 6, 1981, Pat. No. 4,384,929.

[51] Int. Cl.[4] ..... C25D 5/14

[52] U.S. Cl. ..... 204/40; 204/49

[58] Field of Search ..... 204/40, 41, 49; 428/678

[56] References Cited

U.S. PATENT DOCUMENTS

| | | | |
|---|---|---|---|
| 2,837,472 | 6/1958 | Gündel et al. | 204/49 |
| 2,849,351 | 8/1958 | Gündel et al. | 204/44 |
| 2,892,760 | 6/1959 | Gündel et al. | 204/44 |
| 3,090,733 | 5/1963 | Brown | 204/40 X |
| 3,703,448 | 11/1972 | Clauss et al. | 204/40 |
| 4,384,929 | 5/1983 | Tremmel et al. | 204/40 |

*Primary Examiner*—G. L. Kaplan

*Attorney, Agent, or Firm*—Richard P. Mueller

[57] ABSTRACT

An improved process for producing a composite nickel-containing electroplate on a substrate including an inner nickel-containing layer, of an average sulfur content of less than about 0.03 percent by weight, an intermediate nickel-containing layer of an average sulfur content of about 0.05 to about 0.5 percent by weight and an adjacent adherent outer nickel layer of an average sulfur content of about 0.02 to about 0.15 percent but less in sulfur than the intermediate layer and higher in sulfur than the inner layer. The controlled amount of sulfur is introduced into at least the intermediate layer by employing an aqueous acidic nickel solution containing a controlled amount of a thiazole and/or thiazoline additive compound so as to provide an intermediate nickel-containing deposit containing the specified average sulfur content.

8 Claims, No Drawings

PROCESS FOR ELECTRODEPOSITING COMPOSITE NICKEL LAYERS

REFERENCE TO RELATED APPLICATIONS

The present application is a continuation-in-part of prior copending U.S. application Ser. No. 495,793, filed May 23, 1983, and now abandoned, which application is a continuation-in-part of prior copending U.S. application Ser. No. 280,643, filed July 6, 1981, now U.S. Pat. No. 4,384,929.

BACKGROUND OF THE INVENTION

The present invention relates to an improved process for electrodepositing a composite nickel containing electroplate on a corrosion susceptible base metal to achieve corrosion protection thereof. The composite electroplate comprises three adjacent, bonded nickel-containing layers each of a controlled thickness and controlled sulfur content which normally are provided with a conventional chrome plate over the surface of the outer nickel layer achieving exceptional outdoor corrosion protection of the basis metal in comparison to a single or even a duplex nickel-containing electroplate of the same thickness. Such composite nickel-containing electroplates are in widespread commercial use for protecting basis metals such as steel, copper, brass, aluminum or zinc die castings which are subject to outdoor exposure during service, particularly, to marine and automotive service conditions. Beneficial results in corrosion protection are also achieved in the use of such composite nickel-containing layers on plastic substrates which have been subjected to a suitable pretreatment in accordance with well-known techniques to provide an electrically conductive coating thereof such as a copper layer rendering the plastic substrate receptive to nickel electroplating. Typical of such plastic materials which can be electroplated are ABS, polyolefin, polyvinyl chloride, and phenol formaldehyde polymers. Such composite nickel-containing electroplates when used in connection with plastic substrates substantially reduce or eliminate so-called "green" corrosion stains produced by a corrosive attack on a copper basis layer or flash.

Typical of such prior art composite nickel-containing electroplating processes and compositions are those disclosed in U.S. Pat. Nos. 3,090,733 and 3,703,448 the substance of which is incorporated herein by reference. In accordance with U.S. Pat. No. 3,090,733 issued May 21, 1963 a process is disclosed for electrodepositing a three-layered nickel-containing deposit on a substrate in which at least the operating bath for applying the intermediate nickel layer contains selected sulfur compounds to effect a controlled sulfur content in the intermediate nickel-containing layer to achieve the requisite adherence between the composite layers and corrosion protection of the underlying substrate. A further improvement in the foregoing process is disclosed in U.S. Pat. No. 3,703,448 issued Nov. 21, 1972 in which alternative sulfur compounds comprising thiosulfonates of nitriles or amides are employed at least in the operating bath for electrodepositing the intermediate layer.

The process of the present invention provides for still further improvements over the compositions and processes disclosed in the aforementioned two patents employing novel sulfur compounds at least in the operating bath for electrodepositing the intermediate layer which provides for improved bath stability in the presence of air agitation, high temperature and low pH providing for increased plating speeds and reduced consumption of the additive compound. The sulfur additive compound of this invention provides the further advantage in that it can readily be analyzed in the operating bath to maintain its concentration within the optimum operating range and contamination of the operating bath for applying the outer nickel-containing layer with the sulfur additive compound by drag-in from the intermediate layer operating bath does not appreciably affect the sulfur concentration of the outer nickel-containing layer. This latter advantage is important because normally a water rinse step is not employed between the intermediate and outer nickel plating steps and an undesirable increase in sulfur content of the outer nickel layer can in some instances result in hindrance of coverage of the final chromium electrodeposit.

SUMMARY OF THE INVENTION

The benefits and advantages of the present invention are achieved in accordance with the composition aspects thereof by providing an electrolyte comprising an aqueous acidic solution containing nickel ions present in an amount sufficient to deposit an intermediate nickel-containing layer and a thiazole compound and/or a thiazoline compound present in an amount to provide a sulfur content in the deposited intermediate nickel-containing layer of about 0.05 to about 0.5 percent and of the structural formulae:

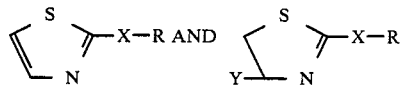

Wherein:
X is S, NH;
R is H, R';
R' is $-(CH_2)_n-SO_3M$, $-(CH_2)_n CO_2M$;
n is an integer from 1 to 4;
Y is $-SO_3M$;
M is Na, K, $NH_4$, H;
as well as mixtures thereof.

In order to attain a sulfur concentration in the intermediate layer within the range hereinabove specified, the thiazole compound and/or thiazoline compound are typically present in an amount of about 0.01 to about 0.4 grams per liter (g/l) with amounts of about 0.03 to about 0.1 g/l being preferred. The intermediate operating bath may also optionally and preferably contain wetting agents and buffering agents such as boric acid, for example.

In accordance with the process aspects of the present invention, a metal substrate, or a plastic substrate, the surface of which has been rendered electrically conductive, is electroplated to form an inner nickel-containing layer generally of a thickness of about 0.15 to about 1.5 mils containing an average sulfur concentration of less than about 0.03 percent followed by the electrodeposition of an intermediate nickel-containing layer at a thickness of about 0.005 to about 0.2 mils and a sulfur content of about 0.05 to about 0.5 percent followed by an outer nickel-containing layer of a thickness generally about 0.2 to about 1.5 mils and a sulfur content of about 0.02 to about 0.15 percent. The sulfur concentration of the outer nickel layer is less than that of the intermediate layer but is greater than that of the inner layer which may be substantially sulfur free. Typically, each of the three nickel-containing layers can be electrodeposited from a Watts-type nickel plating bath with the intermediate and outer operating baths containing the thiazole and/or thiazoline additive compound in concentrations sufficient to deposit the requisite sulfur content in the respective layers. The individual operating baths generally are operated within a temperature of about room temperature (20° C.) up to about 85° C. and in the case of acidic operating baths, within a pH range of about 1 to 6.

Additional benefits and advantages of the present invention will become apparent upon a reading of the Description of the Preferred Embodiments taken in conjunction with the specific examples provided.

DESCRIPTION OF THE PREFERRED EMBODIMENTS

The composite nickel-containing electroplate can be produced employing electrolytes of the types disclosed in U.S. Pat. Nos. 3,090,733 and 3,703,448, the substance of which is incorporated herein by reference, with the exception that in at least the intermediate operating bath, the sulfur compound comprises the thiazole and/or thiazoline compound or derivatives thereof of the specific types hereinafter to be described. Accordingly, the electrolyte for depositing the inner nickel layer may comprise a Watts-type nickel plating bath, a fluoroborate, a high chloride, a sulfamate nickel plating bath or a substantially sulfur-free semi-bright nickel plating bath of the types heretofore known. The electrolyte for depositing the intermediate nickel-containing layer may be of the same type employed for depositing the inner nickel-containing layer but further containing the thiazole and/or thiazoline additive compound in appropriate amounts to achieve the requisite sulfur content in the intermediate layer. Similarly, the electrolyte for depositing the outer nickel-containing layer may be similar to that employed for the intermediate layer with the exception that the concentration of the thiazole and/or thiazoline compound or alternative sulfur-containing compounds will be controlled to provide a net sulfur content in the outer layer in an amount less than that of the intermediate layer. When a decorative plating finish is desired, the outer nickel-containing layer is preferably produced from a bright nickel plating bath employing one or more of the organic sulfo-oxygen compounds such as set forth in Table II of U.S. Pat. No. 2,512,280 and Table II of U.S. Pat. No. 2,800,440 which compounds are also preferably used with unsaturated compounds or amines to give both leveling and brilliance. The three nickel-containing electrolytes may also contain optional components of the types conventionally employed including bath soluble and compatible wetting agents to prevent pitting, buffering agents such as boric acid, formic acid, citric acid, acetic acid, fluoboric acid, or the like.

An electrolyte suitable for depositing the inner nickel-containing layer comprises a Watts-type bath containing about 200 to 400 g/l nickel sulfate hexahydrate, about 30 to about 100 g/l nickel chloride hexahydrate, and about 30 to about 60 g/l boric acid as a buffering agent. The bath can be operated at a temperature of about room temperature (20° C.) up to about 85° C. at a pH of about 1 to about 6.

The intermediate high sulfur nickel-containing layer can be deposited from an electrolyte as employed for the inner nickel-containing layer but further containing from about 0.01 to about 0.4 g/l and preferably from about 0.03 to about 0.1 g/l of the thiazole and/or thiazoline additive compound of the structural formulae:

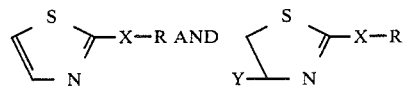

Wherein:
X is S, NH;
R is H, R';
R' is $-(CH_2)_n-SO_3M$, $-(CH_2)_n CO_2M$;
n is an integer from 1 to 4;
Y is $-SO_3M$;
M is Na, K, $NH_4$, H;
as well as mixtures thereof.

Particularly suitable thiazole compounds corresponding to the first structural formula are 2-mercapto thiazole propane sulfonic acid, sodium salt, and 2-amino thiazole propane sulfonic acid, sodium salt. Particularly suitable thiazoline compounds corresponding to the second structural formula hereinbefore set forth are 1-amino-5-sulfo thiazoline, sodium salt, and 2-mercapto thiazoline.

The specific quantity of the thiazole and/or thiazoline additive compound added to the electrolyte for the intermediate nickel-containing layer will vary depending upon the specific molecular weight of the compound or mixture of compounds employed, the concentration of other constituents present in the electrolyte, the operating parameters under which the bath is operated and the relative concentration of sulfur in the outer nickel layer to be deposited. Conventionally, the thiazole and/or thiazoline additive compound is controlled so as to provide a sulfur content in the intermediate layer from about 0.05 up to about 0.5 percent by weight, and preferably, about 0.1 to about 0.2%. This sulfur content can usually be attained by employing the thiazole and/or thiazoline additive with amounts of either compound or mixtures thereof of about 0.03 to about 0.1 g/l usually being preferred.

The outer nickel-containing layer is elctrodesposited from an electrolyte similar to that employed for depositing the inner layer with the exception that the outer layer electrolyte contains appropriate sulfur compounds so as to deposit sulfur in the outer nickel-containing layer within a range of about 0.02 to about 0.15 percent by weight. Appropriate sulfur compounds which are preferred are those conventionally employed in bright and satin nickel baths such as, for example, sodium allyl sulfonate, sodium styrene sulfonate, saccharin, benzene sulfonamide, naphthalene trisulfonic acid, benzene sulfonic acid and the like. The thiazole and/or thiazoline additive, benzene sulfinate and thiosulfonates of nitrile or amides are generally not preferred. In any event, the sulfur content in the outer nickel-containing layer is less that that of the intermediate layer but greater than that of the inner layer. The inner layer should have a sulfur content no more than about 0.03 percent by weight, and preferably less than about 0.01 percent by weight.

In accordance with the process aspects of the present invention, the tri-layered composite nickel-containing electrodeposit is sequentially applied usually without an intervening water rinse between successive electrolytes. The composite nickel-containing layer is usually applied to a substrate having a strike of copper, brass, nickel, cobalt or nickel-iron alloy. The inner nickel-containing layer is usually applied in a thickness greater than the outer nickel-containing layer. In order to achieve optimum corrosion protection from the composite electroplate, the ratio of thickness of the inner to the outer nickel-containing layers may range from about 50:50 up to about 80:20. The intermediate layer is conventionally applied at a thickness of about 0.005 to about 0.2 mils followed by an outer layer of a thickness of about 0.2 to about 1.5 mils.

In order to achieve optimum atmospheric corrosion protection and decorative appearance, it is usually preferred to apply a final bright conventional chromium plate or a micro-cracked chromium plate or a microporous chromium plate of a thickness of about 0.005 to about 0.2 miles over the outer nickel-containing layer. For substrates that are to be exposed to less severe corrosive conditions during service, the inner and outer nickel-containing layers may be only about 0.15 mils thick to provide for improved corrosion protection.

It will be appreciated that the nickel-containing layers comprising the composite plate may contain other conventional contaminants present in conventional amounts which are introduced into the electrolyte and incorporated in the electrodeposit by way of drag-in or the like. Additionally, cobalt may also be present in the nickel-containing layers in appreciable quantities, such as amounts up to about 50 percent cobalt. For general purposes, however, it has been found preferable that the inner nickel-containing layer be as pure a nickel as possible.

In order to further illustrate the improved composition and process of the present invention, the following examples are provided. It will be understood that the examples are provided by way of illustration and are not intended to be limiting of the scope of the invention as herein described and as set forth in the subjoined claims.

EXAMPLE 1

A test solution A comprising a Watts-type nickel plating solution is prepared containing about 40 ounces per gallon nickel sulfate hexahydrate, 8 ounces per gallon nickel chloride hexahydrate and 6 ounces per gallon of boric acid. 800 milliliters of test Solution A is added to a 1 liter container equipped with nickel anodes and air agitation. The pH of the test solution A is adjusted to 2.5 and the temperature raised to 140° F. (60° C.). 75 mg/l of a wetting agent comprising dihexyl sulfosuccinate is added to the test solution A.

A test solution B is prepared by adding 35 mg/l of 2-mercapto thiazole propane sulfonic acid, sodium salt, to test solution A. A nickel foil is plated from test solution B and upon chemical analysis is found to contain 0.127 percent sulfur.

The nickel foil is prepared by electrolytically cleaning a two inch by 4 inch steel panel in an alkaline cleaner followed by water rinsing and an acid dip in a 20 percent solution of sulfuric acid. The acid dipped panel is thereafter water rinsed and plated in a Woods nickel strike to provide a nickel strike layer. The resultant panel is passivated by anodically electrolyzing the panel for a period of from one to two seconds in an alkaline cleaner. Thereafter the panel is plated in a test solution B at a current density of 45 ASF for a period of 35 minutes. The panel thereafter is water rinsed, dried and the edges are cut and the resultant nickel foil is removed.

EXAMPLE 2

A test solution C is prepared in accordance with the procedure described in Example 1 by adding 50 mg/l of 2-mercapto thiazole propane sulfonic acid, sodium salt, to test solution A. A nickel foil is prepared employing the procedure of Example 1 and upon analysis is found to contain 0.175 percent sulfur.

EXAMPLE 3

A test solution D is prepared by adding 35 mg/l of 2-amino-5-sulfo thiazoline, sodium salt, to test solution A and a nickel foil is prepared employing the procedure as described in Example 1. A chemical analysis of the sulfur content of the foil reveals a concentration of 0.150 percent.

EXAMPLE 4

A test solution E is prepared by adding 50 mg/l of 2-amino-5-sulfo thiazoline, sodium salt, to test solution A and a nickel foil is prepared employing the procedure as described in Example 1. A chemical analysis of the sulfur content of the foil reveals a concentration of 0.201 percent sulfur.

EXAMPLE 5

A test solution F is prepared by adding 35 mg/l of 2-amino thiazole propane sulfonic acid, sodium salt, to test solution A and a nickel foil is prepared employing the procedure as described in Example 1. A chemical analysis of the sulfur content of the foil reveals a concentration of 0.132 percent sulfur.

EXAMPLE 6

A test solution G is prepared by adding 50 mg/l of 2-amino thiazole propane sulfonic acid, sodium salt, to test solution A and a nickel foil is prepared employing the procedure as described in Example 1. A chemical analysis of the sulfur content of the foil reveals a concentration of 0.178 percent sulfur.

EXAMPLE 7

A test solution H is prepared by adding 10 mg/l of 2-mercapto thiazoline to test solution A and a nickel foil is prepared employing the procedure as described in Example 1. A chemical analysis of the sulfur content of the foil reveals a concentration of 0.139 percent sulfur.

EXAMPLE 8

A test solution I is prepared by adding 20 mg/l of 2mercapto thiazoline to test solution A and a nickel foil is prepared employing the procedure as described in Example 1. A chemical analysis of the sulfur content of the foil reveals a concentration of 0.305 percent sulfur.

EXAMPLE 9

A test solution C as described in Example 2 is prepared and used under the conditions described in Example 1 for plating a 1.25 by 6 inch steel panel rolled at one end to produce an extremely low current density area. The plating of the panel is conducted at 30 amperes per square foot (ASF) for a period of 7 minutes. The resulting nickel deposit is of a semi-bright lustre with good coverage over the low to high current density areas.

The test solutions B through I as described in the foregoing examples are eminently satisfactory for use as an electrolyte for depositing the nickel-containing intermediate layer to provide a sulfur concentration within the desired range of about 0.05 to about 0.3 percent by weight. The thiazole and/or thiazoline additive compound provides not only the advantage of improved stability of the electrolyte and high speed plating rates by additionally does not appreciably affect the performance and sulfur content of the outer nickel-containing layer as a result of drag-in of the intermediate layer electrolyte into the outer layer electrolyte. It has been discovered that when using such thiazole and/or thiazoline additive compounds, less sulfur is deposited with an increase in pH. Accordingly, the operation of the intermediate layer electrolyte at a pH of about 2.5 provides satisfactory sulfur content in the intermediate layer. However, drag-in of the additive into the bright nickel electrolyte for depositing the outer nickel-containing layer which typically is at a pH of about 3.5 to about 4.5 does not appreciably raise the sulfur content of the bright nickel outer deposit.

EXAMPLE 10

A series of test solutions designated as J, K and L is prepared by the addition to test solution A of Example 1, 25 mg/l, 50 mg/l and 100 mg/l, respectively, of 2-mercapto thiazoline of a molecular weight of 119.2.

A brass appearance panel and a nickel foil are plated from each of test solutions J, K and L at a temperature of about 135° to about 145° F. at a pH of 2.5 in the presence of air agitation with each solution containing 75 mg/l of the wetting agent dihexyl sulfosuccinate. The 1 by 6 inch brass appearance panel is first electrolytically cleaned in an alkaline cleaner, rolled at one end to create a low current density area, water rinsed, acid dipped in a 20 percent sulfuric acid solution, water rinsed and thereafter plated in the test solution at about 40 ASF for a period of 5 minutes. The appearance panel is thereafter unrolled and the overall deposit evaluated for appearance in the high and low current density areas as well as for adhesion of the deposit. The nickel foils prepared as described in Example 1 are also analyzed for percent sulfur content.

Subsequent analysis and observation revealed a nickel foil containing 0.348 percent sulfur produced by test solution J, a sulfur content of 0.396 in the nickel foil produced by test solution K and a sulfur content of 0.848 percent in the foil produced employing test solution L. It is apparent that the use of this additive compound at the same general molecular concentrations as the compounds previously described in the foregoing examples results in an appreciable increase in the sulfur content of the nickel layer above that normally desired to achieve satisfactory adherence of the overlying outer nickel layer of the composite plate. Nevertheless, the general appearance of the panel was satisfactory and adhesion was acceptable. Accordingly, the concentration of 2-mercapto thiazoline is preferably controlled at concentrations less than about 60 mg/l in accordance with the compositions of test solutions H and I of Examples 7 and 8 to provide an intermediate nickel layer containing the desired amount of sulfur.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. In a process for electrodepositing a composite three-layered nickel-containing layer on a substrate wherein an inner nickel-containing layer having an average sulfur content of less than about 0.3 percent by weight is electrodeposited on the substrate, an adherent intermediate nickel-containing layer having an average sulfur content from about 0.05 to about 0.5 percent by weight is electrodeposited on said inner layer and an outer adherent nickel-containing layer having an average sulfur content of from about 0.02 to about 0.15 percent by weight is electrodeposited on said intermediate layer and, wherein, said outer layer contains a lower average sulfur content than said intermediate layer and a higher average sulfur content than said inner layer, the improvement which comprises electrodepositing said intermediate layer from an aqueous acidic solution containing nickel ions in an amount sufficient to deposit the desired intermediate nickel-containing layer and a thiazole and/or thiazoline additive compound present in an amount sufficient to provide the desired sulfur content in the deposited intermediate nickel-containing layer, said thiazole and/or thiazoline additive compound having the structural formulae:

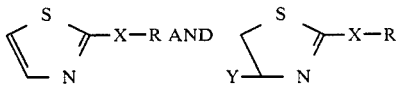

wherein:
X is S, NH;
R is H, R';
R' is $—(CH_2)_n$, $—SO_3M$, $—(CH_2)_n CO_2M$;
n is an integer from 1 to 4;
Y is $—SO_3M$;
M is Na, K, $NH_4$, H;
as well as mixtures thereof.

2. The process as defined in claim 1 in which said additive compound is present in an amount to provide a sulfur content in the desposited intermediate layer of about 0.1 to about 0.2 percent by weight.

3. The process as defined in claim 1 wherein said additive compound is 2-mercapto thiazole propane sulfonic acid and salts thereof.

4. The process as defined in claim 1 wherein said additive compound is a 2-amino-5-sulfo thiazoline and salts thereof.

5. The process as defined in claim 1 wherein said additive compound is 2-amino thiazole propane sulfonic acid and salts thereof.

6. The process as defined in claim 1 in which said additive compound is present in an amount of about 0.01 to about 0.4 g/l.

7. The process as defined in claim 1 in which said additive compound is present in an amount of about 0.03 to about 0.1 g/l.

8. The process as claimed in claim 1 wherein said inner layer has a thickness of from about 0.15 to about 1.5 mils, said intermediate layer has a thickeness of from about 0.005 to about 0.2 mils and said outer layer has a thickness of from about 0.2 to about 1.5 mils.

* * * * *